US005528831A

United States Patent [19]

Fortenberry

[11] Patent Number: 5,528,831

[45] Date of Patent: Jun. 25, 1996

[54] BOLT KNIFE ASSEMBLY WITH LOCKING MEMBER

[76] Inventor: Charles K. Fortenberry, Rte. #3, Box 1437, Woodville, Tex. 75979

[21] Appl. No.: 290,156

[22] Filed: Aug. 15, 1994

[51] Int. Cl.[6] ..... B26B 3/06; B26B 11/00

[52] U.S. Cl. ..... 30/161; 7/158; 7/118; 7/165; 30/160

[58] Field of Search ..... 7/158, 118, 165; 30/151–161, 337, 339, 342, 344

[56] References Cited

U.S. PATENT DOCUMENTS

| | | | |
|---|---|---|---|
| 3,930,309 | 1/1976 | Collins | 30/161 |
| 4,730,394 | 3/1988 | Sonner, Jr. | 30/160 X |
| 5,093,995 | 3/1992 | Jan | 30/161 |

*Primary Examiner*—D. S. Meislin
*Attorney, Agent, or Firm*—Phillip A. Rein

[57] ABSTRACT

A bolt knife assembly with locking member having a knife blade assembly pivotally connected to a handle and support body assembly which is secured in either a retracted or extended orientation by means of a lock nut member. An accessory member, such as a screwdriver, is releasably connectable to the handle and support body assembly. The handle and support body assembly is constructed from an ordinary threaded bolt with a support handle member mounted thereon providing comfortable handling characteristics. The knife blade assembly includes a knife blade member with a cutting blade section at one end and a pivot and lock section at the another end allowing an anchor member to pivotally connect the knife blade assembly to the handle and support body assembly. The lock nut member is an irregularly shaped component with six side wall sections, including four adjoining normal central side wall sections and two non contiguous modified side wall sections being an extended alignment and locking section and a retracted alignment and locking section, forming an access slot therebetween. The extended alignment and locking section and the retracted alignment and locking section are configured such that their interaction with first and second lock tang sections of the knife blade assembly eliminate the need for springs or other prestressed metal parts to lock the knife blade member in either an extended or retracted position.

14 Claims, 3 Drawing Sheets

BOLT KNIFE ASSEMBLY WITH LOCKING MEMBER

PRIOR ART

A patent search was not conducted on this invention.

PREFERRED EMBODIMENT OF THE INVENTION

In one preferred embodiment of this invention, a bolt knife assembly with locking member includes a handle and support body assembly having a knife blade assembly pivotally connected thereto which is secured in either a retracted or extended position by a lock nut member. Further, the handle and support body assembly accommodates an accessory member.

The handle and support body assembly is constructed of a support body member providing 1) primary structural support; and 2) a retracted blade enclosure. A support handle member is mounted about the support body member allowing comfortable handling of the invention. The support body member is fashioned from a standard bolt having an outer head section integral with a main body section into which is longitudinally cut an elongated blade storage slot. The elongated blade storage slot does not cut entirely through the diameter of the main body section until it reaches a threaded end section of the support body member thereby forming a tang clearance slot. A shaft support hole is drilled laterally through the threaded end section. The outer head section has a accessory receiving opening axially aligned with the support body member.

The support handle member includes a main handle section which provides comfortable handling characteristics having a hexagonal outer surface generally aligned with the hexagonal nature of the outer head section of the support body member to which it is attached. A central blade receiving opening in the support handle member is aligned with the elongated blade storage slot in the support body member.

The knife blade assembly comprised a knife blade member pivotally connected at one end by an anchor member or support shaft mounted in the shaft support hole in the threaded end section. The knife blade member extends from a tip of a cutting blade section, having a cutting edge to a pivot and lock section integrally formed with 1) a first lock tang section with a lock contact surface; 2) a second lock tang section with a contact lock surface; and 3) a mounting lug portion with a laterally drilled or transverse connector hole or opening.

The lock nut member is formed from a standard nut modified to an irregular shape providing specific interaction with the aforementioned first lock tang section and second lock tang section. As is conventional, the lock nut member has an internal threaded opening or hole and six side wall sections divided into four adjoining central side wall sections of normal appearance. The two raining side wall sections are modified to include an extended alignment and locking section and a retracted alignment and locking section which are not contiguous but forming an access slot between them.

The extended alignment and locking section provides an extended locking surface which engages the lock contact surface of the knife blade member when in an extended position thereby preventing accidental closure of the knife blade member. An elevational view of the lock nut member reveals an upper wall of the extended alignment and locking section has been skewed upward along the access slot forming an extended inclined abutment portion and extended blade alignment surface which interfaces with the first lock tang section aligning the knife blade member with the access slot when retraction is desired.

The retracted alignment and locking section provides a retracted locking surface which engages the contact lock surface of the knife blade member when in a retracted position thereby preventing accidental opening of the knife blade member. An elevational view of the lock nut member reveals a lower wall of the retracted alignment and locking section has been skewed downward along the access slot forming a retracted inclined abutment portion and retracted blade alignment surface which interfaces with the second lock tang section aligning the knife blade member with the access slot when extension is desired.

An accessory member such as any one of commercially available bits, such as a regular or Philips screwdriver head can be placed in the accessory receiver opening providing a versatile tool.

OBJECTS OF THE INVENTION

One object of this invention is to provide a bolt knife assembly with locking member including a knife blade assembly pivotally connected to a handle and support body assembly. The knife blade assembly can be positively secured in an extended or a retracted position using a lock nut member.

Still, another object of this invention is to provide a bolt knife assembly with locking member having a knife blade member that cannot extend or retract inadvertently.

Another object of this invention is to provide a bolt knife assembly with locking member having a support body member economically fashioned from an ordinary bolt with an elongated blade storage slot longitudinally cut into it.

A further object of this invention is to provide a bolt knife assembly with locking member having a support handle member with a hexagonal outer surface for ease of grasping.

One other object of this invention is to provide a bolt knife assembly with locking member having a lock nut member economically formed from an ordinary nut member.

One further object of this invention is to provide a bolt knife assembly with locking member having an irregularly shaped lock nut member with extended and retracted alignment and locking sections that easily align a knife blade member with an access slot.

Another object of this invention is to provide a bolt knife assembly with locking member having a knife blade member pivotally deployed and secured without use of expensive springs or prestressed metal.

Another object of this invention is to provide a bolt knife assembly with locking member that is durable, aesthetically pleasing, economical to manufacture; and substantially maintenance free.

Various other objects, advantages, and features of the invention will become obvious to those skilled in the art from the following discussion, taken in conjunction with the accompanying drawings in which:

FIGURES OF THE INVENTION

Figure 1:
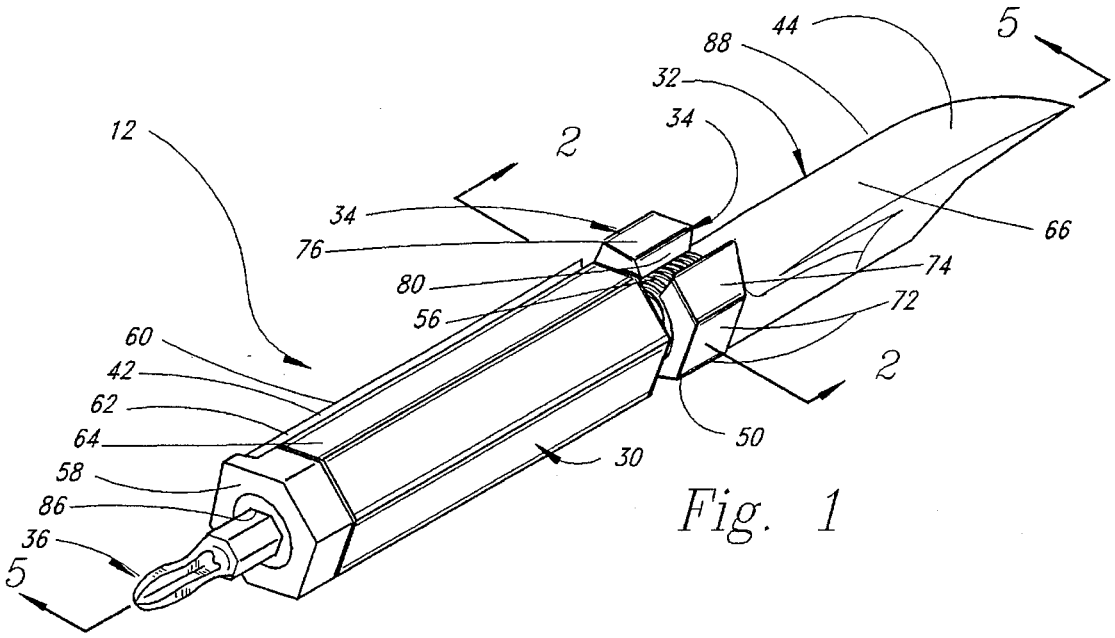
FIG. 1 is a perspective view of a bolt knife assembly with locking member having a knife blade member of this invention in an extended, locked position.
Figure 2:
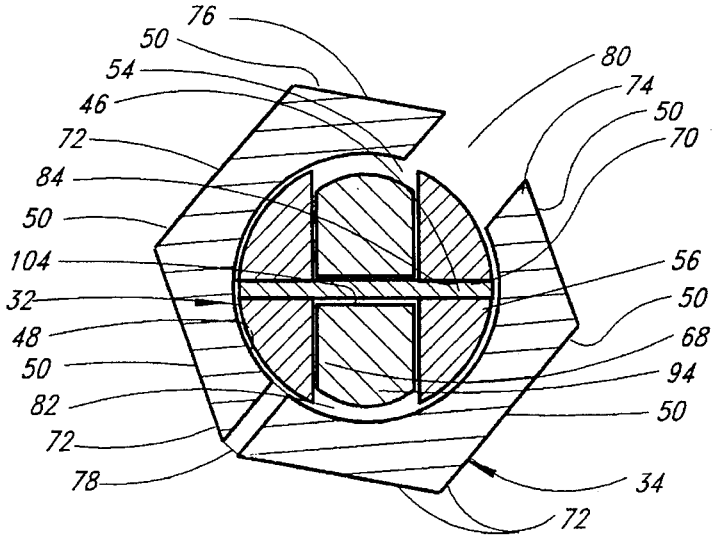
FIG. 2 is an enlarged sectional view taken along line 2—2 in FIG. 1.
Figure 3:
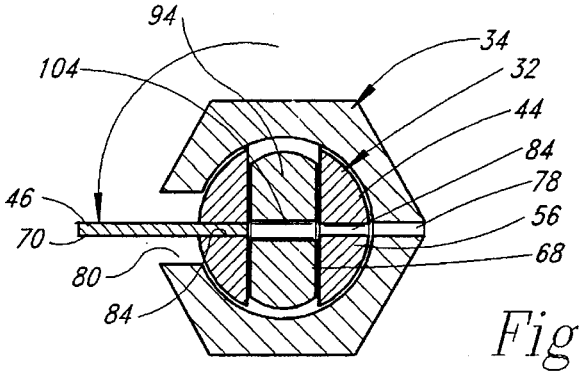
FIG. 3 is a reduced cross sectional view similar to FIG. 2 with a lock nut member rotated to a position allowing insertion or removal of an anchor member.
Figure 4:
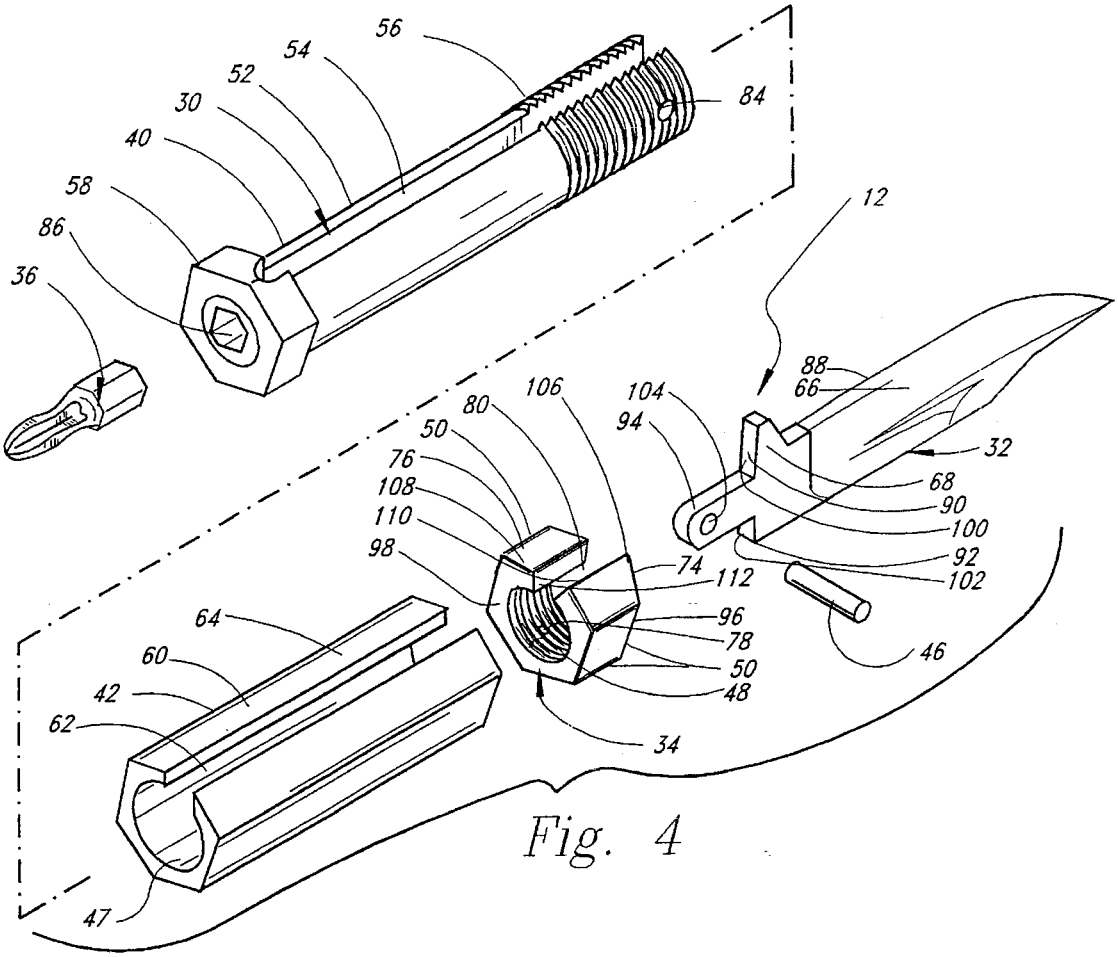
FIG. 4 is an exploded view of the bolt knife assembly with locking member.

The following is a discussion and description of preferred, specific embodiments of a bolt knife assembly with locking member of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, a bolt knife assembly with locking member of this invention, indicated generally at 12, includes a handle and support body assembly 30 pivotally connected to a knife blade assembly 32 which is secured in an extended position by a lock nut member 34. An accessory member 36 can also be attached to the handle and support body assembly 30 as depicted.

Figure 5:
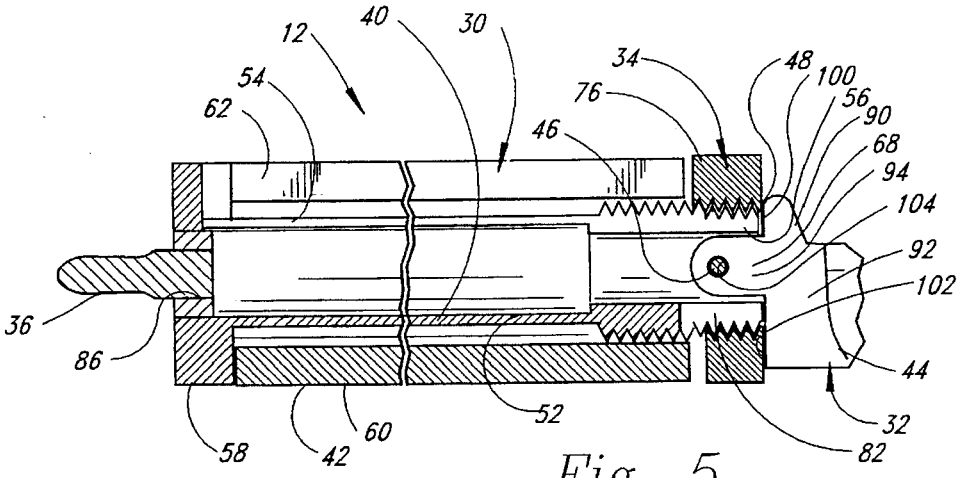
FIG. 5 is an enlarged fragmentary sectional view taken along line 5—5 in FIG. 1.

The handle and support body assembly 30 is constructed of a support body member 40 around which is attached a support handle member 42. The support body member 40 is fashioned from an ordinary bolt having a main body section 52 with a threaded end section 56 at one end and an outer head section 58 at an opposite end. An elongated blade storage slot 54 is longitudinally cut partially through the main body section 52 as best shown in FIG. 5.

As the elongated blade storage slot 54 approaches the threaded end section 56, a tang clearance slot 82 is formed through the entire diameter the threaded end section 56. Positioned in the threaded end section 56 transverse to the tang clearance slot 82 is a shaft support hole 84 ultimately providing pivotal and structural support for the knife blade assembly 32. The outer head section 58 has an accessory receiving opening 86 oriented along the axis of the support body member 40.

The support handle member 42 affords comfortable handling characteristics employing a hexagonal outer surface 64 synchronously aligned with the hexagonal shape of the outer head section 58 of the support body member 40 as shown in FIG. 1. As illustrated in FIG. 5, the support handle member 42 is provided with an elongated central hole 47 to receive the main body section 52 therein and a central blade receiving slot or opening 62 is aligned with the elongated blade storage slot 54 forming a continuous recess to store the knife blade assembly 32 when in a retracted position as will be noted.

The knife blade assembly 32 is comprised of a knife blade member 44 pivotally connected by an anchor member 46 being a support shaft 70 mounted in the shaft support hole 84 in the support body member 40. The knife blade member 44 continues back from a point through a cutting blade section 66 having a cutting edge 88 to an integral pivot and lock section 68. The pivot and lock section 68 is formed with an integrated first lock tang section 90; a second lock tang section 92; and amounting lug portion 94 having a connector hole or opening 104 therein.

As shown in FIG. 5, the lock nut member 34 can be tightened against the first and second lock tang sections 90 and 92 engaging a lock contact surface 100 and a contact lock surface 102 respectively, thereby providing a rigid, non-collapsible structure with the knife blade member 44 in an extended, usage position.

The lock nut member 34 is constructed from an ordinary nut member having an internal threaded opening or hole 48 and six side wall sections 50 with four adjoining central side wall sections 72 being of generally normal configuration. However, the remaining two side wall sections 50 have been adapted to an irregular shape for specific functions.

Referring to FIGS. 6–9, inclusive, an extended alignment and locking section 74 and a retracted alignment and locking section 76 are formed non-contiguously such that an access slot 80 is present between the locking sections 74 and 76. A pivot pin access hole or opening 78 is diametrically opposite the access slot 78 for assembly purposes. The extended alignment and locking section 74 has an extended locking surface 96, basically the top surface of the lock nut member 34, forming the top of an extended inclined abutment portion 106 protruding above the ordinary plane of the lock nut member 34. An outer vertical wall of the extended alignment and locking section 74 serves as an extended blade alignment surface 110.

The retracted alignment and locking section 76 has a retracted locking surface 98, basically the lower surface of the lock nut member 34, forming the top of a retracted inclined abutment portion 108 protruding above the ordinary plane of the lock nut member 34. An outer vertical wall of the retracted alignment and locking section 76 serves as a retracted blade alignment surface 112 with the access slot 80 formed between the aligned surfaces 110 and 112.

USE AND OPERATION OF THE INVENTION

The bolt knife assembly with locking member 12 of this invention is constructed of four assemblies or parts: 1) a handle and support body assembly 30 providing a bolt-like support body member 40 and a support handle member 42; 2) a knife blade assembly 32 having a pivotally connected knife blade member 44 mounted by means of an anchor member 46; 3) a lock nut member 34 of irregular shape being modified to perform various knife blade member 44 locking and aligning functions; and 4) an accessory member 36, commonly a commercially available hexagonal bit style implement such as the Philips head screwdriver bit as shown.

To assemble the bolt knife assembly with locking member 12, the support handle member 42 is mounted about the main body section 52 of the support body member 40 and secured thereto by adhesive or the like. The central blade receiving opening or slot 62 is aligned with the elongated blade storage slot 54.

The lock nut member 34 is threadably mounted on the threaded end section 56 of the support body member 40.

Next, the knife blade member 44 is placed in the elongated blade storage slot 54 such that the pivot and lock section 68 rests in a clevis area of the threaded end section 56 laterally aligning the connector hole or opening 104 with the shaft support hole 84. The locking nut member 34 is rotated such that the access slot 80 is aligned with the shaft support hole 84 allowing the anchor member 46 to be inserted through the shaft support hole 84 in the threaded end section 56; through the connector hole or opening 104 of the knife blade assembly 32; and finally through the shaft support hole 84 of an opposite portion of the threaded end section 56. The anchor member 46 is secured and of a length such that it does not interfere with the free rotation of lock nut member 34.

The lock nut member 34 is essentially an ordinary nut with an internal threaded opening or hole 48 and six side wall sections 50. The four adjoining central side wall sections 72 are connected at outer upright edges by respective ones of the modified extended alignment and locking section 74 and the similarly modified retracted alignment and locking section 76 being separated by the access slot 80 having the pivot pin access hole or opening 78 diametrically opposed.

Figure 7:
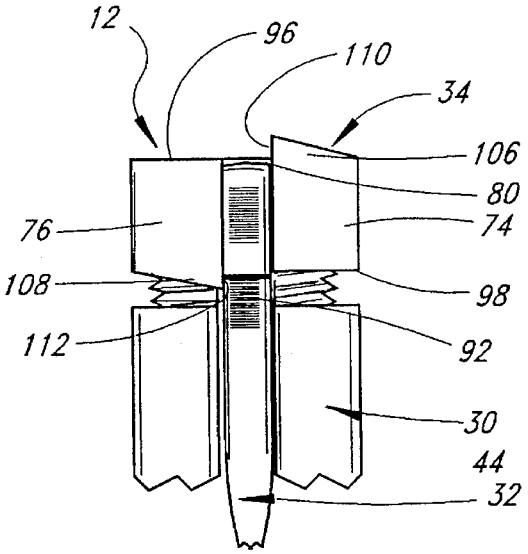
FIG. 7 is a fragmentary elevational view similar to FIG. 6 with a lock nut member rotated to present the knife blade member in an unlocked position ready to be deployed to an extended position.
Figure 8:
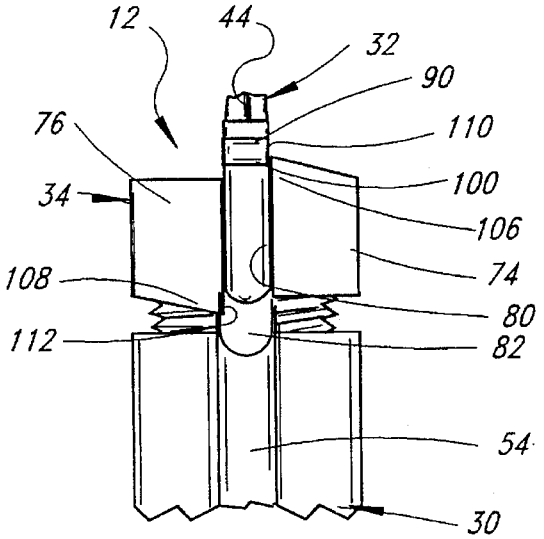
FIG. 8 is a fragmentary elevational view similar to FIG. 7 with the knife blade member in an extended position.

The extended alignment and locking section 74 is irregularly shape being skewed along the top surface forming the extended inclined abutment portion 106 as illustrated in FIGS. 7 & 8. When the knife blade member 44 is in an extended position as shown in FIG. 8, the locking nut member 34 is rotated counterclockwise, as noted by an arrow 116, until the extended locking surface 96 engages contact lock surface 102 and lock contact surface 100 as depicted in FIG. 9 to anchor the knife blade member 44 in the extended, usage position.

Figure 9:
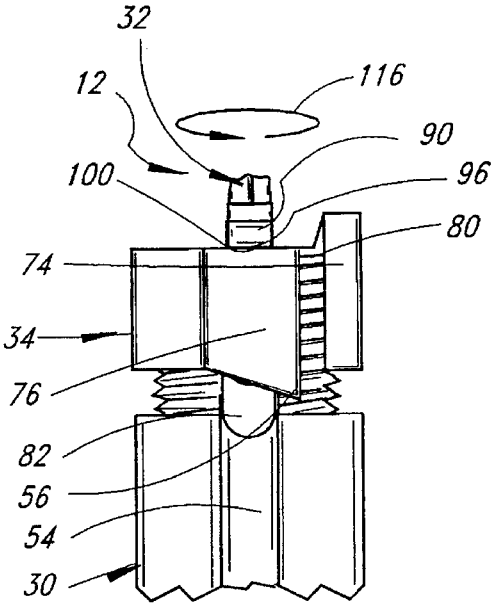
FIG. 9 is a fragmentary elevational view similar to FIG. 8 with the lock nut member rotated to secure the knife blade member in a locked, extended position.

To retract the knife blade member 44, the locking nut member 34 is rotated clockwise from FIG. 9 until the extended blade alignment surface 110 contacts the first lock tang section 90 thereby aligning the access slot 80 with the knife blade member 44 and the elongated blade storage slot 54 to the position shown in FIG. 8. Then, the knife blade member 44 can be pivoted about the anchor member 46 to the position of FIG. 7.

Figure 6:
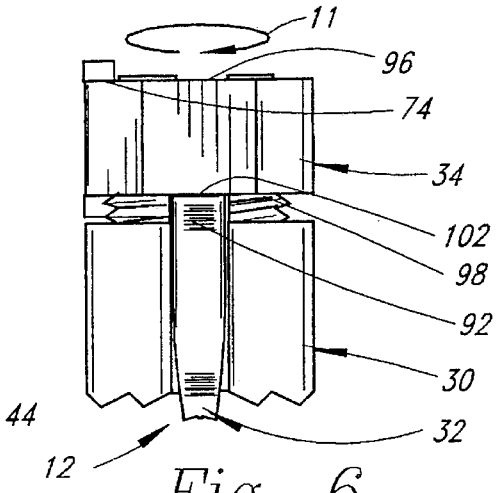
FIG. 6 is a fragmentary elevational view of the bolt knife assembly with locking member with a knife blade member locked in a retracted position.

When the locking nut member 34, being rotated clockwise from the position of FIG. 7 as noted by an arrow 114 (FIG. 6), with the knife blade member 44 in a retracted position, a retracted locking surface 98 of the extended alignment and locking section 74 engages contact lock surface 102 thereby locking the knife blade member 44 in a retracted position as shown in FIG. 6.

In order to extend the knife blade member 44 from the stored or retracted position of FIG. 6, the locking nut member 34 is rotated counterclockwise as per arrow 116 until the retracted blade alignment surface 112 of a retracted inclined abutment portion 108 contacts the second lock tang section 92. This aligns the access slot 80 with the elongated blade storage slot 54 as illustrated in FIG. 7 allowing the knife blade member 44 to be extended to the position as shown in FIG. 8.

The locking nut member 34 can then be further rotated counterclockwise per the arrow 116 to the extended, locked position of FIG. 9.

The accessory member 36 can be one of any number of commercially available implements available being selectively insertable into the accessory receiving opening 86 of the support body member 40. The hexagonal outer surface 64 of the support handle member 42 provides a comfortable grip for using the accessory member 36.

The bolt knife assembly with locking member of this invention is sturdy in construction; economical to manufacture; easy to use; and substantially maintenance free.

While the invention has been described in conjunction with preferred specific embodiments thereof, it will be understood that this description is intended to illustrate and not to limit the scope of the invention, which is defined by the following claims:

I claim:

1. A bolt knife assembly with locking member, comprising:

a) a support body member having an elongated blade storage slot and a threaded end section;

b) a knife blade assembly having a knife blade member pivotally connected to said support body member and selectively movable from a first enclosed position within said elongated blade storage slot to a second extended position laterally of said elongated blade storage slot;

c) a lock member mounted on said threaded end section being axially movable thereon in one direction to engage and anchor said knife blade member in said first enclosed position; and d) said lock member axially movable on said threaded end section in another direction to engage and anchor said knife blade member in said second extended position.

2. A bolt knife assembly with locking member as described in claim 1, wherein:

a) said support body member having an outer head section with an accessory receiving opening; and b) an accessory member is releasably and selectively mounted in said accessory receiving opening and being utilized for various screwdriver or other similar type functions.

3. A bolt knife assembly with locking member as described in claim 1, wherein:

a) said lock member includes an internal threaded opening threadably mounted on said threaded end section and having a plurality of interconnected side wall sections; and b) a pair of adjacent ones of said side wall sections forming an access slot therebetween operable to be aligned with said elongated blade storage slot in said support body member to permit said knife blade member to be pivoted from the first enclosed position to the second extended position and locked in a selected one of said positions on rotation of said lock member.

4. A bolt knife assembly with locking member as described in claim 1, including:

a) a support handle member mounted on said support body member having a central blade receiving opening aligned with said elongated blade storage slot; and b) said support handle member having an outer hexagonal outer surface for ease of grasping by the user thereof.

5. A bolt knife assembly with locking member as described in claim 1, wherein:

a) said knife blade member having a blade cutting section integral with a pivot and lock section;

b) said pivot and lock section having a first lock tang section and a second lock tang section;

c) said lock member rotatable to place said first lock tang section having a lock contact surface in engagement with said lock member to hold in the extended position; and d) said lock member rotatable in an opposite direction to place said second lock tang section with a contact lock surface in engagement therewith to anchor in the enclosed position.

6. A bolt knife assembly, comprising:

a) a support body member includes an outer head section connected to a main body section having an end section and an elongated blade storage slot;

b) a knife blade assembly having a knife blade member with one end pivotally connected to said end section;

c) a lock member mounted on said end section;

d) said lock member engagable in one position with one end of said knife blade member to anchor in a retracted position and engagable in another position with said one end of said knife blade member to anchor in an extended position;

e) said lock member is threadably mounted on and axially movable relative to said end section; and f) said lock member having an access slot which is selectively aligned with said elongated blade storage slot to permit pivotal movement thereof from the enclosed or retracted positions to the extended position.

7. A bolt knife assembly, comprising:

a) a support body member includes an outer head section connected to a main body section having an end section and an elongated blade storage slot;

b) a knife blade assembly having a knife blade member with one end pivotally connected to said end section;

c) a lock member mounted on said end section;

d) said lock member engagable in one position with one end of said knife blade member to anchor in a retracted position and engagable in another position with said one end of said knife blade member to anchor in an extended position;

e) said lock member having a plurality of interconnected side wall sections with two adjacent ones, being an extended alignment locking section and a retracted alignment and locking section, having an access slot therebetween;

f) said extended alignment and locking section having an extended locking surface and an extended blade alignment surface; and g) said extended blade alignment surface selectively engagable with a portion of said knife blade member to achieve alignment of said access slot with said elongated blade storage slot during pivotal movement of said knife blade member from the retracted position to the extended position.

8. A bolt knife assembly as described in claim 7, wherein:

a) said retracted alignment locking section having said retracted blade alignment surface engagable with a portion of said knife blade member to provide alignment thereof on moving said knife blade member from the extended to the retracted position; and b) said retracted inclined abutment portion engagable with a portion of said knife blade member to hold in the retracted position.

9. A bolt knife assembly as described in claim 1, including:

a) an accessory tool member mounted in an accessory receiver opening in said main body section of said support body member;

whereby said accessory tool member can be used to perform numerous functions such as a socket, a screwdriver head, and the like.

10. A pocket bolt knife assembly, comprising:

a) a handle and support body having a support handle member mounted on a support body member which resembles a bolt member;

b) said support body member includes an outer head section integral with a main body section having an outer threaded end section;

c) said support handle member and said main body section each having a blade storage slot aligned with each other;

d) a knife blade assembly including a knife blade member having a pivot and lock section which is pivotally connected to said threaded end section;

e) said knife blade member is selectively pivotal from a storage position within said blade storage slots to an extended position laterally of said blade storage slots;

f) a lock nut member threadably mounted on said threaded end section for limited axial movement;

g) said lock nut member having an access slot selectively aligned with said blade storage slots permitting said knife blade member to pass therethrough when moving from the storage position to the extended position;

h) said lock nut member rotatable in one direction transversely of said blade storage slots and engagable with said pivot and lock section to anchor said knife blade member in the storage position; and i) said lock nut member rotatable in another direction transversely of said blade storage slots and engagable with said pivot and lock section to anchor said knife blade member in the extended position.

11. A pocket bolt knife assembly as described in claim 10, wherein:

a) said pivot and lock section having a first lock tang section with a lock contact surface and a second lock tang section with a contact lock surface and a mounting lug portion having a connector opening therein to receive a pivot pin therein for pivotally connecting to said threaded end section;

b) said first lock tang section having said lock contact surface engagable with a lock nut member to hold in the extended position; and c) said second lock tang section having said contact lock surface engagable with said lock nut member to anchor in the retracted position.

12. A pocket bolt knife assembly as described in claim 10, wherein:

a) said lock nut member having a plurality of central wall sections interconnected to each other and outer ones of said central side wall sections secured to an extended alignment and locking section and a retracted alignment and locking section having an access slot therebetween;

b) said extended alignment and locking section having an extended locking surface;

c) said extended locking surface engagable with said pivot and lock section on rotation of said lock nut member to hold said knife blade member in the extended position;

d) said retracted alignment and locking section having a retracted locking surface; and e) said lock nut member selectively rotatable when said knife blade member is in the retracted position to contact said retracted locking surface to anchor said knife blade member in the extended position.

13. A foldable bolt knife assembly comprising:

a) a handle and support body assembly;

b) a knife blade assembly having a knife blade member pivotally connected to said handle and support body assembly; and c) a lock nut member mounted on said handle and support body assembly selectively movable axially to engage said knife blade member to anchor in an extended or retracted position.

14. A foldable bolt knife assembly as described in claim 13, wherein:

a) said handle and support body assembly includes a support body member and attached support handle member provided with a main body section having a threaded end section at one end and an outer head section at an opposite end; and b) said support handle member is constructed so as to be suitably secured to said main body section and of exterior dimensions consistent with said outer head section.

* * * * *